United States Patent [19]

Sullivan

[11] Patent Number: 4,576,308

[45] Date of Patent: Mar. 18, 1986

[54] TANK HATCH OPENING OBSTRUCTING CONSTRUCTION

[75] Inventor: Jeffrey R. Sullivan, Boston, N.Y.

[73] Assignee: McGard, Inc., Buffalo, N.Y.

[21] Appl. No.: 732,671

[22] Filed: May 10, 1985

[51] Int. Cl.[4] ..... B65D 45/00

[52] U.S. Cl. ..... 220/327; 220/254; 220/375; 220/324

[58] Field of Search ..... 220/254, 324, 327, 375

[56] References Cited

U.S. PATENT DOCUMENTS

| | | | |
|---|---|---|---|
| 2,360,554 | 10/1944 | Englert | 220/327 |
| 2,499,614 | 3/1950 | Thornhill | 220/254 |
| 4,378,896 | 4/1983 | Begnaud | 220/327 |

*Primary Examiner*—George T. Hall

*Attorney, Agent, or Firm*—Joseph P. Gastel

[57] ABSTRACT

An obstructing plate construction for a tank having an opening in a top wall thereof and a cover with a base plate having an opening aligned with the opening in the top wall, the obstructing plate construction including an adapter plate mounted between the base plate and the top wall, bolts permanently affixed to the adapter plate for receiving nuts at the underside of the top wall, an opening in the adapter plate aligned with the opening in the top wall and the opening in the base plate, a plurality of nut and bolt assemblies extending through the base plate, adapter plate and top wall for securing them in assembled relationship, an obstructing plate, and locking bolts for selectively securing the obstructing plate to the adapter plate in obstructing relationship to aligned openings in the base plate, adapter plate and top wall.

35 Claims, 16 Drawing Figures

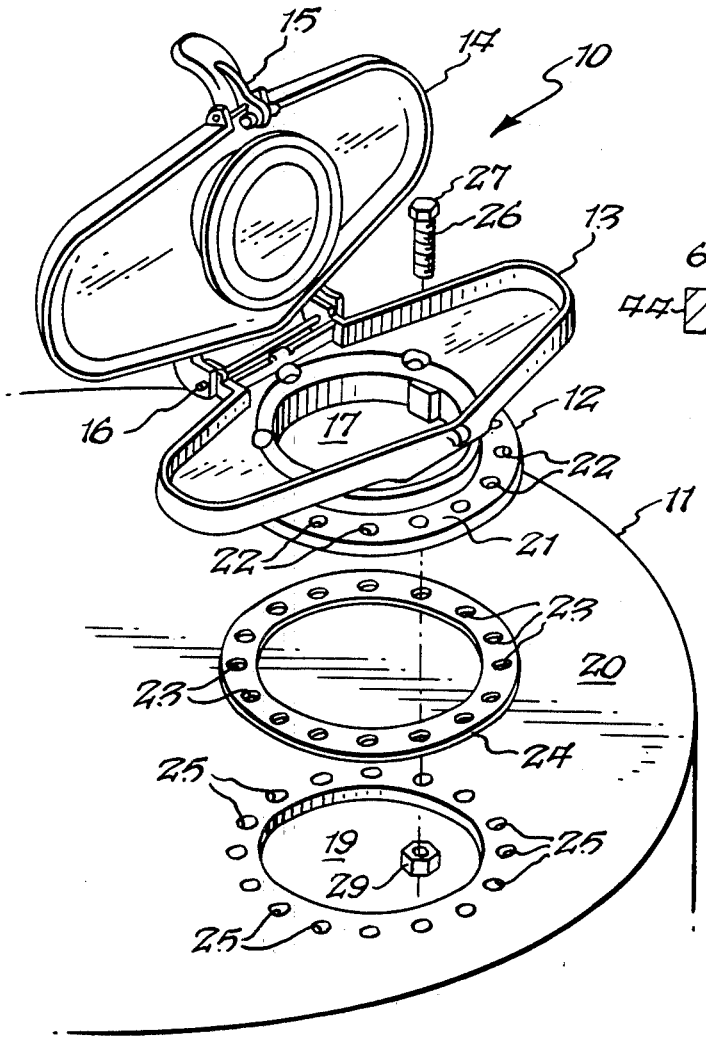
Fig. 1.
PRIOR ART
Fig. 6.
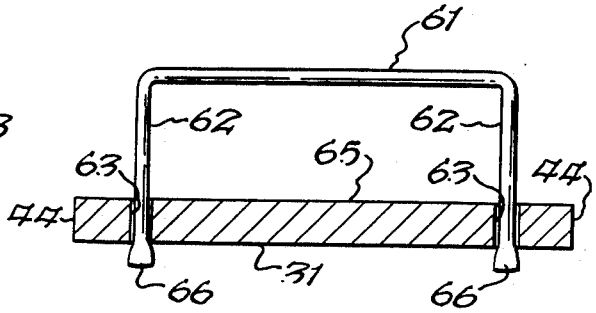
Fig. 4.
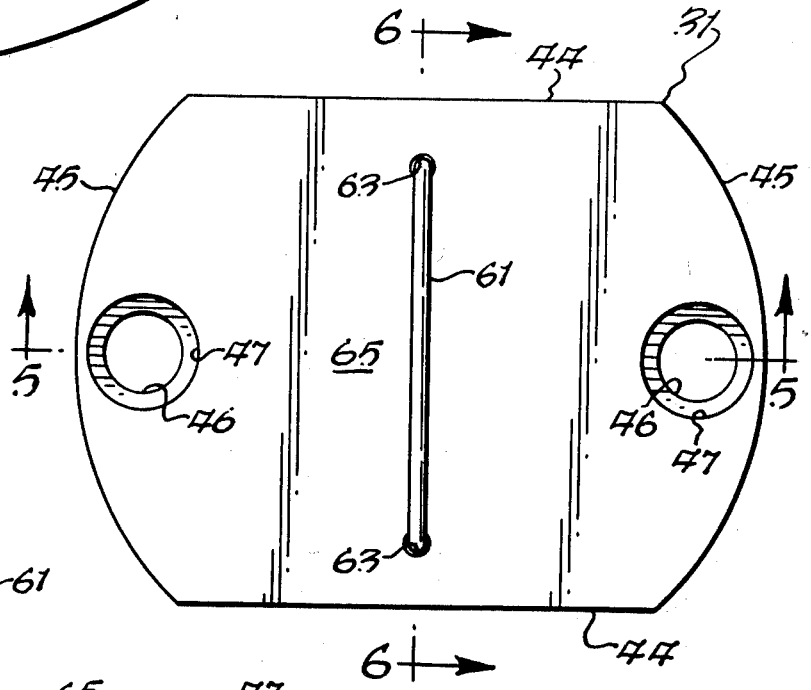
Fig. 5.
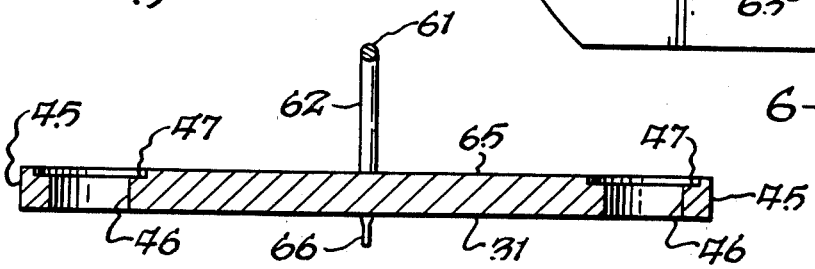

Fig. 3.
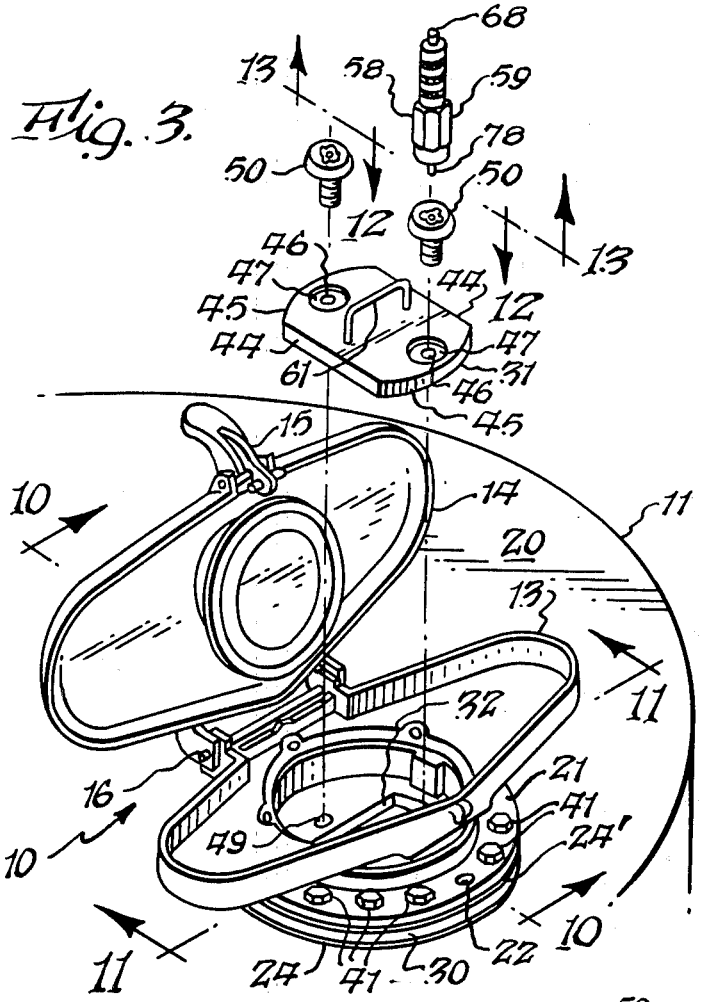
Fig. 13.
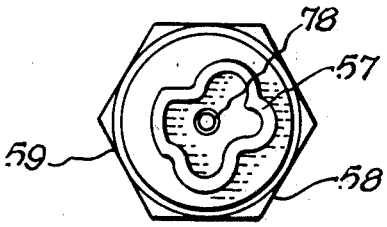
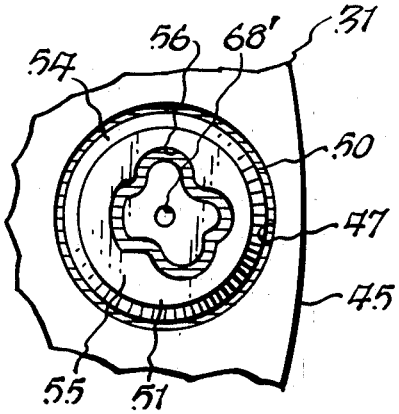
Fig. 12.
Fig. 11.
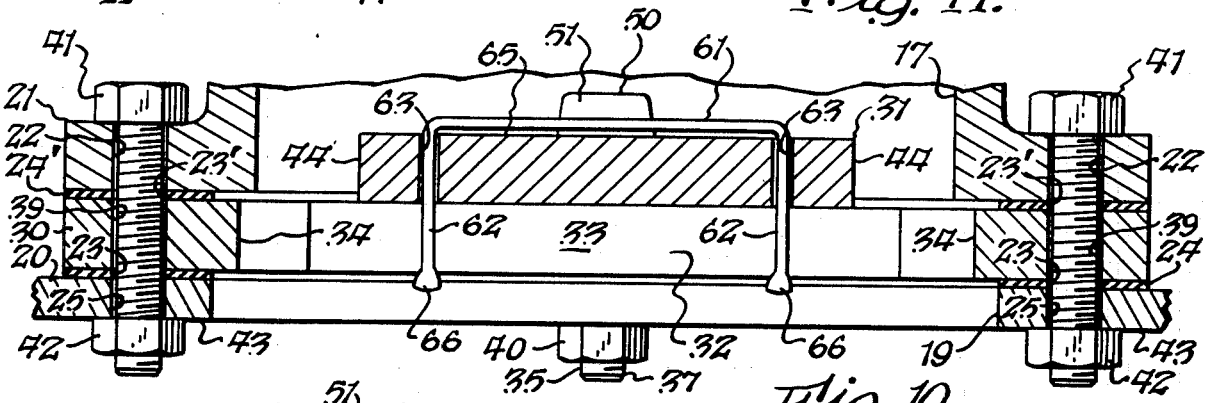
Fig. 10.
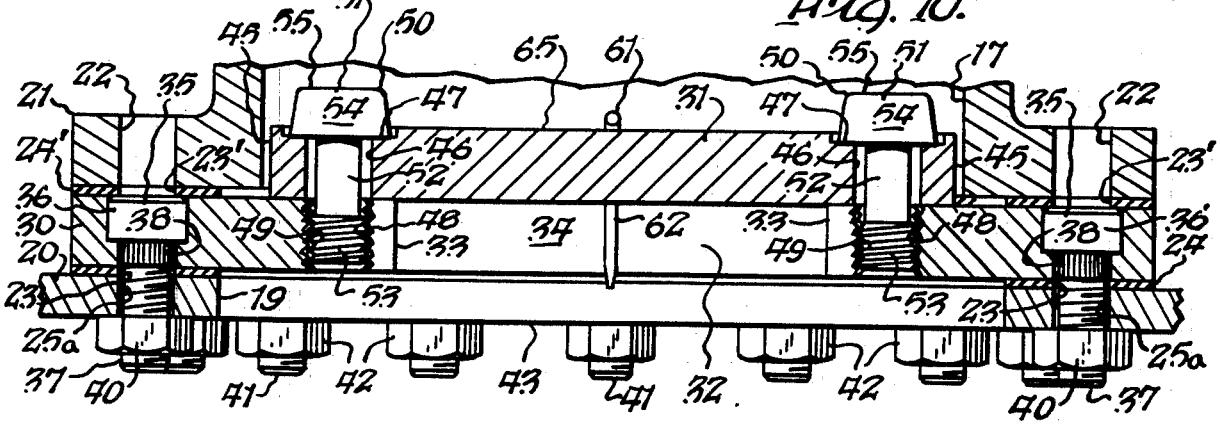

TANK HATCH OPENING OBSTRUCTING CONSTRUCTION

BACKGROUND OF THE INVENTION

The present invention relates to a locking construction for obstructing the opening of a thief hatch of a tank.

By way of background, gasoline and petroleum tanks of the type used in tank farms for storing petroleum and other types of products have a thief hatch in the top wall thereof. The thief hatch is an opening which receives a device called a "thief" which is lowered into the tank to bring up a sample of its contents. The "thief" device does not imply that products are being stolen. However, the thief hatch permits the tank contents to be stolen by parties who insert a conduit into the tank through the thief hatch and pump out the tank contents. The present invention relates to a thief hatch obstructing plate construction which is locked to the top of the tank in obstructing relationship to the thief hatch opening to thereby prevent a conduit from being inserted into the tank through this opening.

SUMMARY OF THE INVENTION

It is one object of the present invention to provide an obstructing plate construction for mounting in locked relationship to the top wall of a tank over the hatch opening to thereby prevent access to the contents of the tank.

Another object of the present invention is to provide a tank hatch opening obstructing construction which allows proper venting of tank contents while preventing access thereto.

Still another object of the present invention is to provide an improved tank hatch opening obstructing structure which can be associated with existing tank hatch cover constructions.

A further object of the present invention is to provide a tank hatch opening obstructing construction which can be installed easily and which can be removed easily when access is required to the tank contents. Other objects and attendant advantages of the present invention will readily by perceived hereafter.

The present invention relates to a hatch opening obstructing construction comprising a plate having first and second opposite sides, bolt means having first and second portions, said first portion extending outwardly from said first side and said second portion being recessed within said first and second sides of said plate so as to be inaccessible from said second side to a wrench for turning said bolt means, nut means for mounting on said first portion of said bolt means, an obstructing plate for mounting on said plate in overlying relationship to said opening, and locking means for selectively locking said obstructing plate to said plate, said obstructing plate being oriented relative to said nut means so as to obstruct direct access thereto through said opening.

The present invention also relates to an opening obstructing structure on a wall having a wall opening therein, the wall opening obstructing structure for obstructing said wall opening comprising a plate, a plate opening in said plate for placement in registry with said wall opening, bolt means on said plate for securing said plate to said wall with said plate opening overlying said wall opening, an obstructing plate, and locking means for selectively locking said obstructing plate to said plate with said obstructing plate in overlying relationship to said plate opening to thereby obstruct said wall opening.

The present invention also relates to an obstructing structure for a thief hatch construction mounted on the top wall of a tank having a wall opening therein, said thief hatch construction including a base plate, a base plate opening in said base plate overlying said wall opening, a plurality of first holes in said top wall surrounding said wall opening, and a plurality of second holes in said base plate in alignment with said first holes for receiving bolts for fastening said base plate to said top wall, an obstructing structure for obstructing said wall opening comprising an adapted plate mounted between said top wall and said base plate, first bolt means extending downwardly from said adapter plate and through at least one of said first holes for securing said adapter plate to said top wall, an adapter plate opening in said adapter plate in registry with said base plate opening and said wall opening, a plurality of third holes in said adapter plate in registry with said first and second holes, second bolt means extending through said first, second and third holes for securing said base plate and said adapter plate to said top wall, an obstructing plate, and locking means for selectively locking said obstructing plate to said adapter plate in obstructing relationship to said adapter plate opening to thereby obstruct said wall opening.

The various aspects of the present invention will be more fully understood when the following portions of the specification are read in conjunction with the accompanying drawings wherein:

BRIEF DESCRIPTION OF THE DRAWINGS

FIG. 1 is a fragmentary perspective exploded view of a prior art thief hatch cover;

FIG. 3 is a fragmentary perspective view of the adapter plate and thief hatch cover installed on the tank and the obstructing plate shown in exploded relationship thereto;

FIG. 4 is a plan view of the obstructing plate;

FIG. 5 is a cross sectional view taken substantially along line 5—5 of FIG. 4;

FIG. 6 is a cross sectional view taken substantially along line 6—6 of FIG. 4;

FIG. 10 is a fragmentary enlarged cross sectional view taken substantially along line 10—10 of FIG. 3 and showing the adapter plate and obstructing plate in assembled relationship with each other and the thief hatch cover on the top wall of the tank;

FIG. 11 is a fragmentary enlarged cross sectional view taken substantially along line 11—11 of FIG. 3 and showing the various parts in assembled relationship;

FIG. 12 is a fragmentary enlarged plan view taken substantially in the direction of arrows 12—12 of FIG. 3 and showing the curvilinear groove in the head of the bolt for locking the obstructing plate to the adapter plate;

FIG. 13 is an enlarged view taken substantially in the direction of arrows 13—13 of FIG. 3 and showing the ridge configuration in the key for mating with the curvilinear groove in the locking bolt;

DESCRIPTION OF THE PREFERRED EMBODIMENTS

Figure 2:
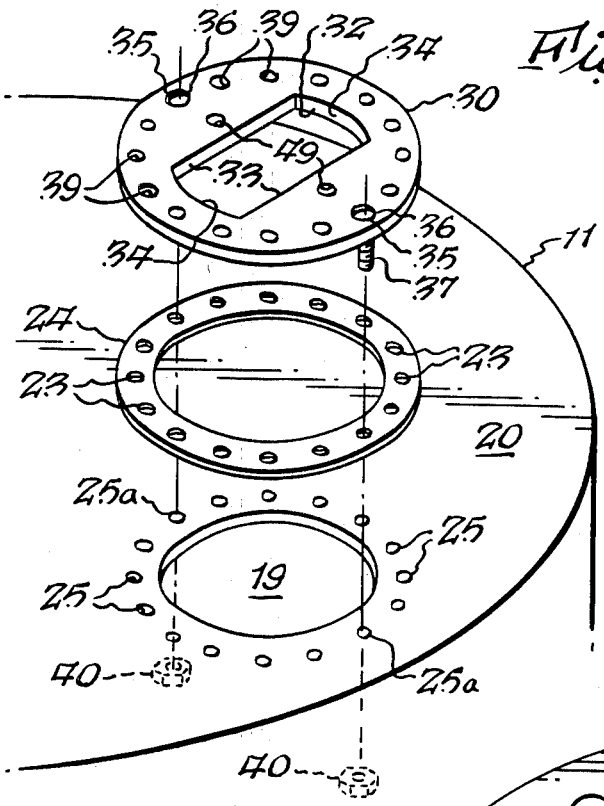
FIG. 2 is a fragmentary perspective exploded view showing the adapter plate of the present invention in relation to the tank onto which it is to be mounted.
Figure 9:
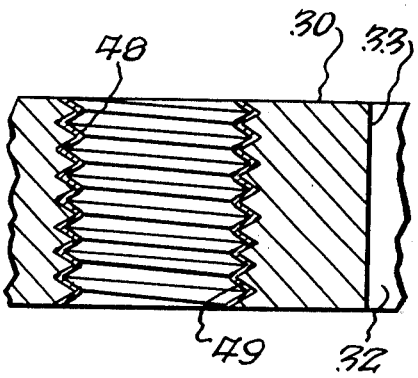
FIG. 9 is a fragmentary enlarged view of the section designated FIG. 9 in FIG. 8.

In FIG. 1 a prior art thief hatch cover 10 is shown in exploded relationship relative to a tank 11 on which it is mounted. Insofar as pertinent here, the thief hatch cover 10 includes a base 12 and a trough-like housing 13 mounted thereon. A cover 14, having a latch 15, is hinged to trough 13 by pin 16. Cover 14 selectively closes trough 13. The thief hatch cover 10 includes an opening 17 which overlies opening 19 in tank top wall 20. Base 12 includes an annular rim 21 having a plurality of holes 22 therein which register with holes 23 in gasket 24 and holes 25 in top wall 20. A plurality of bolts 26 extend through aligned holes 22, 23 and 25 to secure base rim 21 to tank top 20. In this respect, bolt heads 27 bear on the upper surface of base rim 21 and nuts 29 thread onto the shanks of bolts 26 and bear on the underside of top wall 20.

The thief hatch obstructing structure of the present invention prevents theft of the tank contents by providing an obstructing plate which is locked across tank top opening 19 to thereby prevent the insertion of a hose therethrough which can be used for pumping out the contents of the tank. Broadly, the obstructing construction (FIG. 7) includes an adapter plate 30 and obstructing plate 31 which is locked thereto to obstruct tank top opening 19.

The hatch opening obstructing construction is installed in the following manner. First of all, the thief hatch cover 10 is removed from tank top 20 by unscrewing bolts 26. Thereafter, adapter plate 30 is mounted onto tank top 20 with gasket 24 therebetween. Adapter plate 30 is of generally annular shape, and it has an elongated opening 32 (FIG. 7) therein bordered by long edges 33 and short edges 34. A pair of hardened bolts 35 have serrated portions 38 below head portions 36 press-fitted into adapter plate 30 and their lower threaded portions 37 extending downwardly for insertion through diametrically opposed holes 25*a* (FIG. 2) in tank top wall 20, the bolts 35 also extending through a pair of diametrically opposed holes 23 of gasket 24 (FIG. 2). Adapter plate 30 also has holes 39 therein which register with the holes 23 in gasket 24 and holes 25 in tank top wall 20. Nuts 40 are threaded onto bolts 35 to firmly secure adapter plate 30 to tank top 20 with gasket 24 therebetween. In order to tighten nuts 40, a wrench has to be inserted through tank top opening 19. The nuts 40 are tightened onto bolts 35 with a high torque and preferably with an anaeorbic adhesive therebetween.

After the adapter plate 30 has been installed, another gasket 24′ (FIG. 10), which is identical to gasket 24, is placed on the top surface of adapter plate 30 and the base rim 21 of cover 10 is mounted on gasket 24′ with the holes 22 in alignment with the holes 23′ of gasket 24′. Thereafter, a plurality of bolts 41 are inserted through all of the holes 22 in base rim 21 except the two holes which overlie the tops 36 of bolts 35. Nuts 42 are then threaded onto bolts 41 so that they bear on the underside 43 of tank top 20 to tightly mount the cover 10 onto adapter plate 30. In order to tighten bolts 41, a wrench is inserted through opening 19 and applied to nuts 42.

In order to obstruct opening 19 in tank top wall 20, an obstructing plate 31 is locked to adapter plate 30. Obstructing plate 31 (FIGS. 4–6) is an elongated plate having long sides 44 and short sides 45. Holes 46 are located in the ends of plate 31 and counterbores 47 are associated therewith. Holes 46 are aligned with holes 49 in adapter plate 30.

Obstructing plate 31 is installed by aligning holes 46 with holes 49, which are threaded. Thereafter hardened locking bolts 50, which cannot be chiseled or otherwise mutilated, are inserted through aligned hole pairs 46–49 and are threaded into holes 49. Locking bolts 50 include a head 51 with a shank 52 having threads 53 at its lower end. Head 51 has a frustoconical outer surface 54 which cannot be gripped with a wrench. The top surface 55 of head 51 includes an endless curvilinear groove 56 therein for receiving a mating curvilinear ridge 57 of key 59 which is used both to tighten locking bolts 50 to adapter plate 30 and to remove them. The curvilinear grooves 56 and the mating curvilinear ridge 57 by themselves form no part of the present invention as they have been disclosed in U.S. Pat. Nos. 3,241,408 and 4,480,513 which are incorporated herein by reference. For installing and removing bolts 50, a wrench is applied to the hexagonal body portion 58 of key 59. A screw 68 is loosely mounted in key 59 and has a threaded end 78 which is threadably received in tapped bore 68′ of bolt 50 to attach key 59 to bolt 50 when bolt 50 is to be turned. It will be appreciated that while bolts, such as 50, are deemed to be the best mode for locking obstructing plate 31 to adapter plate 30, other types of locking arrangements may also be used. To firmly secure bolts 50 in threaded bores 49, thread inserts 48 known under the trademark HELICOIL are used which greatly increase the torque which must be applied to bolts 50 during installation and removal, thereby tending to prevent loosening of bolts 50 by jarring. The thread inserts 48 also protect the threads of adapter plate 30 from being mutilated in the event it is made of relatively soft material, such as aluminum, which is used to prevent the possibility of creating sparks during installation. The obstructing plate 31 also has a handle 61 with legs 62 which are loosely received in bores 63. Handle 61 can drop down so that it rests on top surface 65 of obstructing plate 31 and can be lifted to the position shown in FIG. 6 during installation and removal of obstructing plate 31. The bottoms of legs 62 are crimped at 66 to prevent handle 61 from being detached from plate 31.

Figure 7:
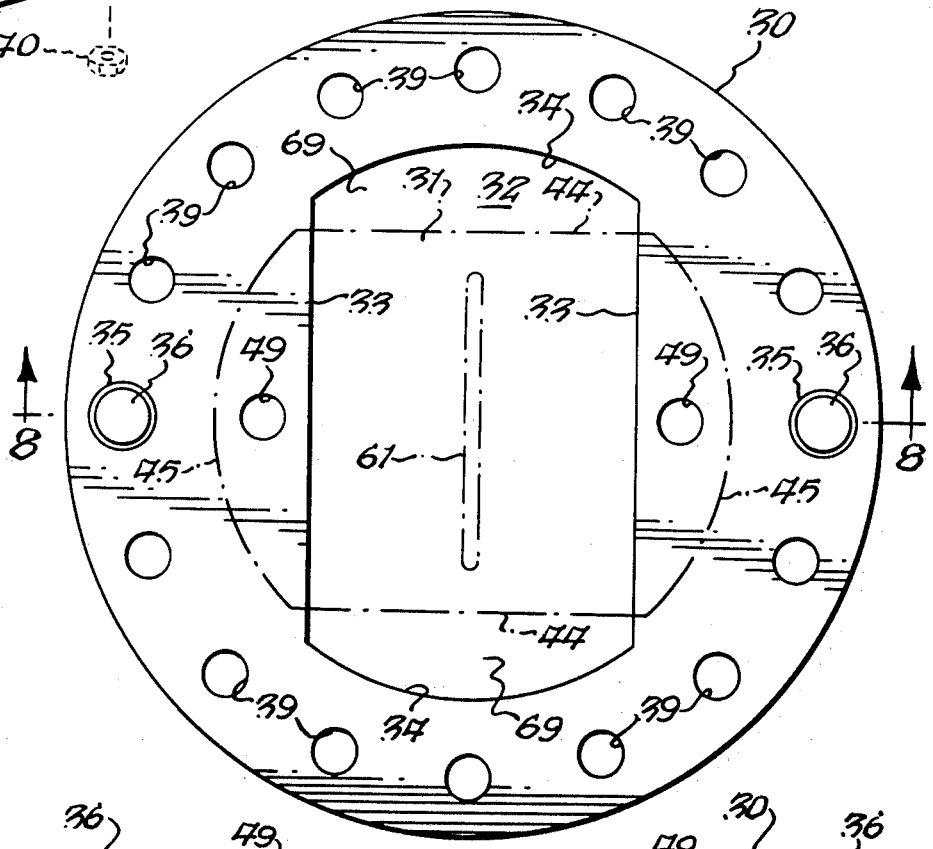
FIG. 7 is a plan view of the adapter plate with the obstructing plate shown in phantom lines and in overlying relationship thereto.
Figure 8:
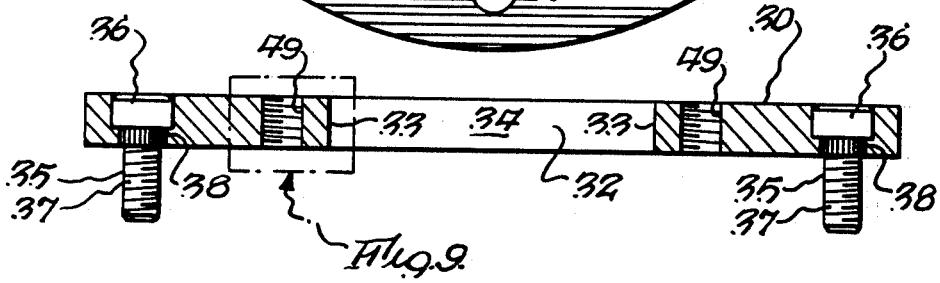
FIG. 8 is a cross sectional view taken substantially along line 8—8 of FIG. 7.

When obstructing plate 31 is in its installed position, it is oriented as shown in phantom lines in FIG. 7 relative to adapter plate 30, so that there are openings 69 between the obstructing plate 31 and adapter 30 for venting purposes and to permit the tank contents to be plumbed. However, as can readily be visualized from FIG. 7, obstructing plate 31 not only covers substantially the entire opening 19 in tank top wall 20 to prevent the insertion of a conduit of any significant size, but it also obstructs access to nuts 40 at the ends of bolts 35 thus preventing the adapter plate from being demounted from top wall 20. Furthermore, obstructing plate 31 also obstructs access to most of nuts 42.

Figure 14:
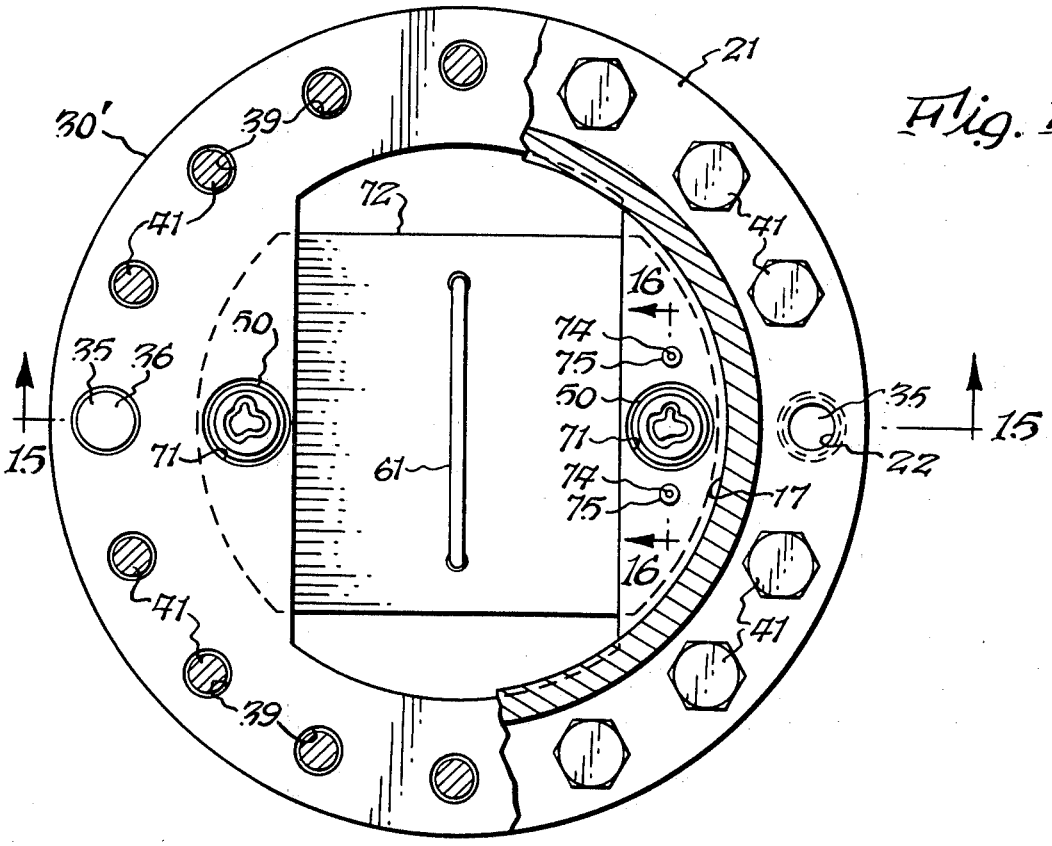
FIG. 14 is a fragmentary view, partially in cross section, taken substantially along line 14—14 of FIG. 15, and showing an alternate embodiment of the present invention with the obstructing plate mounted on the underside of the adapter plate.
Figure 15:
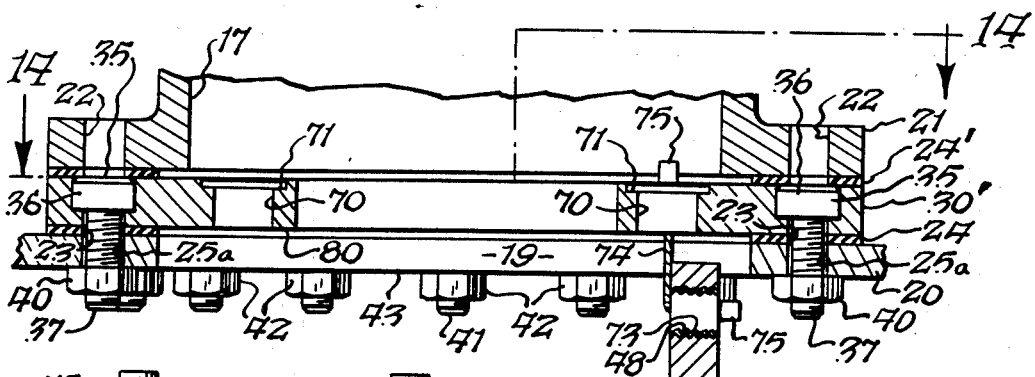
FIG. 15 is a fragmentary cross sectional view taken substantially along line 15—15 of FIG. 14 and showing the obstructing plate in unlocked relationship to the adapter plate and hanging downwardly into the tank.
Figure 16:
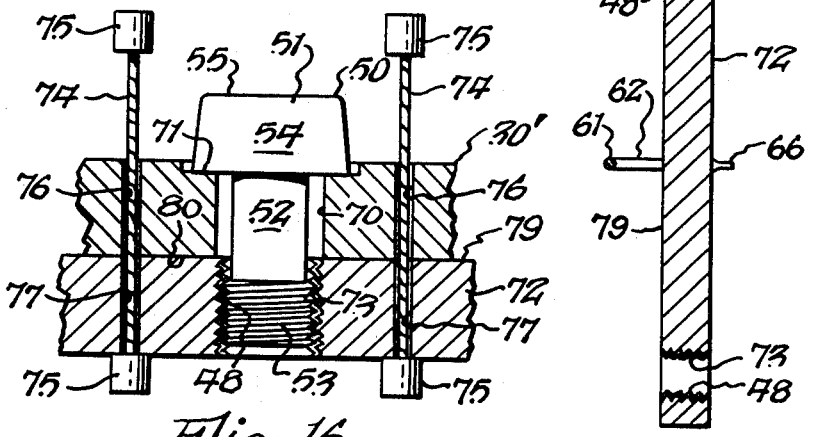
FIG. 16 is a cross sectional view taken substantially along line 16—16 of FIG. 14 and showing both the locking attachment and the retaining cables between the adapter plate and obstructing plate.

In FIGS. 14–16 a modified embodiment of the present invention is disclosed. In this embodiment adapter plate 30' is of the same general shape as adapter plate 30 and it has holes 39 which receive bolts 41 as in the previously described embodiment. Furthermore, the base rim 21 of thief hatch cover 10 is secured by bolts 41 as in the prior embodiment. Adapter plate 30' also has bolts 35 which are identical to bolts 35 described above. However, obstructing plate 30' differs from obstructing plate 30 of FIGS. 1–13 in that it has bores 70 therein which receive locking bolts 50 having heads 51 which bear on counterbore surface 71 rather than on the obstructing plate.

In the embodiment of FIGS. 14–16 the obstructing plate 72 has threaded bores 73 therein for receiving the threaded ends 53 of bolts 50. The threaded bores 73 also have HELICOIL® thread inserts 48 therein for providing a tight fit and for increasing the torque which must be applied during installation and removal, to thereby prevent loosening of bolts 50 by jarring. Steel cables 74 have caps 75 crimped to opposite ends thereof and the cables extend through aligned bores 76 and 77 in adapter plate 30' and obstructing plate 72, respectively. Thus, when bolts 50 do not secure upper surface 79 of obstructing plate 72 in engagement with undersurface 80 of adapter plate 30', obstructing plate 72 will hang as shown in FIG. 15, with cables 74 functioning in the nature of ties to loosely attach the obstructing plate to the adapter plate. When it is desired to lock obstructing plate 72, handle 61 is grasped and the obstructing plate 72 is moved into its obstructing position wherein it obstructs the opening 19 in tank top wall 20, and locking bolts 50 are secured into HELICOIL® thread inserts 48 in bores 73. Locking bolts 50 of FIGS. 14–16 are identical to those described above relative to FIGS. 1–13.

In both embodiments, even if the thief hatch cover 10 could be removed while the obstructing plate is in locked position, the heads 36 of bolts 35 prevent the bolts from being driven downwardly, and, further, the tops of heads 36 are flush with the top of the adapter plate to prevent a tool from being applied thereto for removal purposes.

It can thus be seen that the hatch opening obstructing structure of the present invention is manifestly capable of achieving the above-enumerated objects, and while preferred embodiments of the present invention have been disclosed, it will be appreciated that the present invention is not limited thereto but may be otherwise embodied within the scope of the following claims.

What is claimed is:

1. In a thief hatch construction mounted on the top wall of a tank having a wall opening therein, said thief hatch construction including a base plate, a base plate opening in said base plate overlying said wall opening, a plurality of first holes in said top wall surrounding said wall opening, and a plurality of second holes in said base plate in alignment with said first holes for receiving bolts for fastening said base plate to said top wall, an obstructing structure for obstructing said wall opening comprising an adapter plate mounted between said top wall and said base plate, first bolt means extending downwardly from said adapter plate and through at least one of said first holes for securing said adapter plate to said top wall, an adapter plate opening in said adapter plate in registry with said base plate opening and said wall opening, a plurality of third holes in said adapter plate in registry with said first and second holes, second bolt means extending through said first, second and third holes for securing said base plate and said adapter plate to said top wall, an obstructing plate, and locking means for selectively locking said obstructing plate to said adapter plate in obstructing relationship to said adapter plate opening to thereby obstruct said wall opening.

2. In a thief hatch construction as set forth in claim 1 wherein said first bolt means comprise a plurality of bolts having upper portions fixedly secured to said adapter plate.

3. In a thief hatch construction as set forth in claim 2 wherein said first bolt means include nuts secured to said bolts on the opposite side of said top wall from said adapter plate, and wherein said obstructing plate obstructs access to said nuts.

4. In a thief hatch construction as set forth in claim 1 wherein said locking means comprise a plurality of third bolt means having heads with depressions for receiving keys.

5. In a thief hatch construction as set forth in claim 1 wherein said locking means comprise at least one third bolt means having a head with a depression therein for receiving a key.

6. In a thief hatch construction as set forth in claim 5 wherein said depression is a curvilinear groove.

7. In a thief hatch construction as set forth in claim 5 wherein said obstructing plate has end portions, and wherein said at least one third bolt means is located on one of said end portions outside of said adapter plate opening.

8. In a thief hatch construction as set forth in claim 7 wherein said first bolt means comprise a plurality of bolts on opposite sides of said adapter plate opening and proximate said end portions of said obstructing plate.

9. In a thief hatch construction as set forth in claim 7 wherein said third bolt means comprise a plurality of third bolts located on said end portions on opposite sides of said adapter plate opening.

10. In a thief hatch construction as set forth in claim 1 wherein said locking means include at least one third bolt means having a head with a depression therein for receiving a key, and wherein said obstructing plate has end portions, and wherein said third bolt means is located at at least one end portion, and aligned hole means in said adapter plate and said obstructing plate for receiving said at least one third bolt means, said obstructing plate being located below said adapter plate and having thread means for receiving said at least one third bolt means.

11. In a thief hatch construction as set forth in claim 10 including tie means for loosely attaching said obstructing plate to said adapter plate.

12. In a thief hatch construction as set forth in claim 11 wherein said tie means comprises at least one cable.

13. In a wall having a wall opening therein, a wall opening obstructing structure for obstructing said wall opening comprising a plate, a plate opening in said plate for placement in registry with said wall opening, bolt means on said plate for securing said plate to said wall with said plate opening overlying said wall opening, an obstructing plate, and locking means for selectively locking said obstructing plate to said plate with said obstructing plate in overlying relationship to said plate opening to thereby obstruct said wall opening.

14. In a wall as set forth in claim 13 wherein said wall has a plurality of bolt-receiving openings therein surrounding said wall opening, and wherein said bolt means comprise a plurality of bolts fixedly secured to said plate for insertion through certain of said bolt-receiving openings, nut means for mounting on said plurality of bolts on the opposite side of said wall from said plate to secure said plate to said wall, said obstructing plate being oriented relative to said nut means so as to obstruct direct access to said nut means.

15. In a wall as set forth in claim 14 wherein said bolt-receiving openings in said plate include a plurality of openings for receiving additional bolts for securing said plate to said wall.

16. In a wall as set forth in claim 13 wherein said obstructing plate has end portions, and wherein said locking means are located at at least one of said end portions.

17. In a wall as set forth in claim 16 wherein said wall has a plurality of bolt-receiving openings therein surrounding said wall opening, and wherein said bolt means comprise a plurality of bolts fixedly secured to said plate for insertion through certain of said bolt-receiving openings, nut means for mounting on said plurality of bolts on the opposite side of said wall from said plate to secure said plate to said wall, said obstructing plate being oriented relative to said nut means so as to obstruct direct access to said nut means.

18. In a wall as set forth in claim 16 wherein said locking means comprise at least one bolt having a depression for receiving a key.

19. In a wall as set forth in claim 18 wherein said bolt includes a head, and wherein said depression comprises a curvilinear groove in said head.

20. In a wall as set forth in claim 19 including a threaded opening in said plate for threadably receiving said bolt.

21. In a wall as set forth in claim 17 wherein said locking means comprise a plurality of bolts having depressions for receiving keys.

22. In a wall as set forth in claim 21 wherein each of said bolts includes a head, and wherein said depressions comprise a curvilinear groove in each of said heads.

23. In a wall as set forth in claim 13 including open spaces between said obstructing plate and said plate.

24. In a wall as set forth in claim 18 including a threaded opening in said obstructing plate for threadably receiving said bolt, and opening means in said plate through which said bolt passes, said obstructing plate being located below said plate.

25. In a wall as set forth in claim 24 including tie means for loosely attaching said obstructing plate to said plate.

26. A hatch opening obstructing construction comprising a plate having first and second opposite sides, bolt means having first and second portions, said first portion extending outwardly from said first side and said second portion being recessed within said first and second sides of said plate so as to be inaccessible from said second side to a wrench for turning said bolt means, nut means for mounting on said first portion of said bolt means, an obstructing plate for mounting on said plate in overlying relationship to said opening, and locking means for selectively locking said obstructing plate to said plate, said obstructing plate being oriented relative to said nut means so as to obstruct direct access thereto through said opening.

27. A hatch opening obstructing construction as set forth in claim 26 wherein said bolt means are fixedly secured to said plate.

28. A hatch opening obstructing construction as set forth in claim 27 including a plurality of bolt-receiving openings in said plate for receiving additional bolts.

29. A hatch opening obstructing construction as set forth in claim 26 wherein said locking means comprise at least one bolt means having a depression in its head.

30. A hatch opening obstructing construction as set forth in claim 29 wherein said depression comprises a curvilinear groove.

31. A hatch opening obstructing construction as set forth in claim 26 wherein said locking means comprise a plurality of bolt means having heads with depressions therein.

32. A hatch opening obstructing construction as set forth in claim 31 wherein said depressions comprise curvilinear grooves.

33. A hatch opening obstructing construction as set forth in claim 26 wherein said opening is elongated in a first direction, and wherein said obstructing plate is elongated in a second direction which is transverse to said first direction when said obstructing plate is mounted on said plate so as to provide open spaces on opposite sides of said obstructing plate.

34. A hatch opening obstructing construction comprising a plate having first and second opposite sides, bolt means having a first portion extending outwardly from said first side, said bolt means having a second portion permanently affixed within said first and second sides of said plate, nut means for mounting on said first portion of said bolt means, an obstructing plate for mounting on said plate in overlying relationship to said opening, and locking means for selectively locking said obstructing plate to said plate, said obstructing plate being oriented relative to said nut means so as to obstruct direct access thereto through said opening.

35. In a thief hatch construction mounted on the top wall of a tank having a wall opening therein, said thief hatch construction including a base plate, a base plate opening in said base plate overlying said wall opening, a plurality of first holes in said top wall surrounding said wall opening, and a plurality of second holes in said base plate in alignment with said first holes for receiving bolts for fastening said base plate to said top wall, an obstructing structure for obstructing said wall opening comprising an adapter plate mounted between said top wall and said base plate, said adapter plate having upper and lower surfaces with said lower surface facing said top wall and said upper surface facing said base plate, a plurality of first bolt means fixedly secured to said adapter plate and having lower portions extending downwardly therefrom and through said first holes, nut means for mounting on said first bolt means on the opposite side of said top wall from said adapter plate for securing said adapter plate to said top wall, an adapter plate opening in said adapter plate in registry with said base plate opening and said wall opening, a plurality of third holes in said adapter plate in registry with said first and second holes, second bolt means extending through said first, second and third holes for securing said base plate and said adapter plate to said top wall, said first bolt means being press-fitted into said adapter plate and having uppermost portions located within the confines of said upper and lower surfaces of said adapter plate, an obstructing plate having end portions, and locking means extending through said end portions for selectively locking said obstructing plate to said adapter plate in obstructing relationship to said adapter plate opening to thereby obstruct said wall opening, said end portions of said obstructing plate being located proximate said nut means as to obstruct direct access to said nut means.

* * * * *